US006293236B1

(12) United States Patent
De Francisco

(10) Patent No.: US 6,293,236 B1
(45) Date of Patent: Sep. 25, 2001

(54) BREATHING SYSTEM FOR INTERNAL COMBUSTION ENGINES, USING DUAL DUTY (ALTERNATIVELY EXHAUST-INTAKE) VALVES AND A FORCED AIR SUPPLY

(76) Inventor: Roberto Forero De Francisco, Tv. 1A 55-20, Bogotá(CO)

( * ) Notice: Subject to any disclaimer, the term of this patent is extended or adjusted under 35 U.S.C. 154(b) by 0 days.

(21) Appl. No.: 09/496,958

(22) Filed: Feb. 3, 2000

(30) Foreign Application Priority Data

Feb. 24, 1999 (CO) ..... 99011569

(51) Int. Cl.[7] ..... F02B 37/00
(52) U.S. Cl. ..... 123/79 R; 123/315; 123/432
(58) Field of Search ..... 123/79 R, 315, 123/432

(56) References Cited

U.S. PATENT DOCUMENTS 2,105,699 * 1/1938 Pate ..... 123/79 R
2,107,389 * 2/1938 Price et al. ..... 123/79 R
2,392,060 * 1/1946 Osborn ..... 123/79 R
2,894,495 * 7/1959 Dobrosavlyevitch ..... 123/79 R
3,590,791 * 7/1971 Roosa ..... 123/79 R
4,273,083 * 6/1981 Moiroux ..... 123/79 R
4,608,828 * 9/1986 Mikota ..... 123/79 R
5,020,486 * 6/1991 Unger ..... 123/79 R

* cited by examiner

*Primary Examiner*—Willis R. Wolfe
*Assistant Examiner*—Jason Benton
(74) *Attorney, Agent, or Firm*—Smith, Gambrell & Russell, LLP

(57) ABSTRACT

Breathing system for four-stroke, fuel injected internal combustion engines, wherein each poppet valve of each cylinder accomplishes a dual-duty to serve both as an exhaust valve (in the final process of a given cycle) and subsequently as an inlet valve (in the first process of the following cycle). The passages (external to the cylinder) where the valve ports and stems are located are connected to both the intake and the exhaust manifolds wherein air is forced to flow under pressure by means of a fan (or a blower or a compressor) driven by the engine, in order to sweep away the combustion gases during the exhaust process and subsequently to feed a sufficient amount of fresh air during the intake process.

8 Claims, 2 Drawing Sheets

BREATHING SYSTEM FOR INTERNAL COMBUSTION ENGINES, USING DUAL DUTY (ALTERNATIVELY EXHAUST-INTAKE) VALVES AND A FORCED AIR SUPPLY

BACKGROUND AND ADVANTAGES OF THE SYSTEM OF THE INVENTION

The effective (or brake) horsepower (bhp) that an internal combustion engine can deliver is limited to a great extent by the fluid friction losses, or pressure losses, generated both during exhaust of combustion gases from the cylinder (through the exhaust valves) and intake of air to the cylinder (through the intake valves). Such pressure losses increase the mean effective pressure that the piston has to overcome both during the exhaust stroke and the intake stroke, resulting in work being wasted in each cycle and consequently in less useful effective power being delivered by the engine.

Furthermore, the pressure losses during the intake process also reduce the unit air charge (weight or mass of air drawn into the cylinder per intake stroke) and therefore less fuel can be burned effectively in the combustion process. Consequently, this smaller unit air charge also reduces the thermal energy delivered by the combustion process in each cycle and therefore decreases the effective power delivered by the engine For this reason actual engines usually have intake valves of larger size than exhaust valves, since intake pressure losses have greater negative effects than exhaust pressure losses.

Such pressure losses increase almost as the square of engine speed (rpm) and, for a given speed, the pressure losses decrease almost as the square of the valve opening area (flow area). For this reason, it is desirable to increase as much as is possible the valve opening area in order to obtain a greater power output (bhp) from a given engine However, the space available to accomodate the valves is limited and it is not possible to enlarge the valve opening area by either increasing the size or the number of valves per cylinder beyond a certain practical limit for a given size of engine.

Present four-stroke power cycle reciprocating-piston engines have separate valves with separate passages to accomplish the intake of fresh air into the cylinders and to exhaust the combustion gases from the cylinders. Each valve has its own specific duty. The exhaust valves are not used for the intake of fresh air and the intake valves are not used for the exhaust of combustion gases.

The novel idea of the invention Is to make use of all valves of each cylinder (both the intake valves and the exhaust valves) to accomplish both functions: the exhaust of combustion gases and the intake of fresh air. This is done by modifying the program of operation of the valve driving mechanism (the shape or profile of the cams), and by making use of conduits external to the cylinders and provided with a forced air flow produced by an air impeller (either a fan, or a blower, or a compressor) driven by the engine, in order to sweep away the combustion gases towards the exhaust manifold during the exhaust process and to supply sufficient fresh air to the cylinder during the intake process.

The purpose of the above is to greatly increase the valve opening area as well as the period of time of full opening of the valves, for both the intake and the exhaust process. In this manner, the average valve opening area is substantially increased and, since the pressure losses decrease almost as the square of the valve opening area, a very important gain In the power output (bhp) will be obtained, due to less wasted work being accomplished by the pistons and also due to the increase of the unit air charge, as indicated before. Better efficiency Mill also be obtained and the average fuel consumption for a given amount of work will be reduced In In the engine breathing system of the invention, all valves of each cylinder open gradually from the start of the exhaust process until they reach full opening and remain at full opening for the remainder of the exhaust process. In this way, at the start of the intake process of the next cycle the valves are already fully open Therefore, the time at full opening of the valves is substantially increased for both the exhaust and the intake processes, as compared to the usual engine in which the exhaust valves remain at full opening for a short time, since they have to be closed at the end of the exhaust process. The intake valves follow a similar process since they are closed at the start of the intake process, remain at full opening for a short time and have to be fully closed again at the end on that process In today's engines, it is usual to design for an early opening of the exhaust valves (approximately 48° before the piston reaches the bottom dead center) with the purpose of increasing the effective opening time of the valves in order to decrease the mean effective pressure during the exhaust stroke and consequently to reduce the work of the piston (negative work for the cycle). This is however,accomplished at the expense of obtaining less work from the combustion gases during the power stroke. The net benefit obtained is positive when the engine operates at high speed and high load, but at low speed and high load (for instance during acceleration) the net effect obtained is negative.

In a similar way, It is usual for the intake valves of present engines to close late (approximately 45° after bottom dead center) with the purpose of increasing the unit air charge obtaining more power from the engine. However, this is accomplished at the expense of decreasing the effective compression stroke and therefore lowering the compression ratio, which in turn decreases the thermal efficiency of the cycle which is a function of the compression ratio. As a consequence, the fuel consumption increases, especially at low speeds and high load (full throttle opening).

Taking into consideration that in the system of the invention the flow area (valve opening area) is much larger, and that the time at full opening of the valves is also longer, it is possible to considerably reduce the early opening of the exhaust valves and/or the late closing of the intake valves, with the purpose of reducing the negative effects mentioned before. It is also possible to maintain the accustomed early opening and late closing of the valves, and make use of the much larger flow area to increase the maximum speed of rotation of the engine, increasing in this way its; maximum power.

It is also possible to make use of said much larger flow area and longer time at full opening of the valves to have a more gradual and consequently smoother opening and closing action of the valves or use it to reduce the stroke of the valves, reducing this way the work spent in driving the valves.

Another advantage of the system of the invention is that a better cooling of the valves and of the engine head is obtained from the fresh air flow through the conduits (or passages) where the valve stems and the external face of the valves are located. Furthermore, due to the dual function of exhaust and intake, all valves will receive a flow of fresh air during the intake process immediately after the exhaust process of hot gases. In present engines, the exhaust valves suffer greatly from overheating since they only handle the hot gases of combustion.

Another advantage of the system of the invention is that it is possible (if desired) to use only one cam to drive all valves of each cylinder since they all have the same functions, opening at the same, time and then closing at the same time. To accomplish this, an element serving as a bridge between the valve stems can be used.

It is worthy of note that although the system of the invention makes use of a fan (or blower or compressor), as some supercharged engines do, it differs from this system. While the purpose of the supercharged is to overcome the fluid friction pressure losses during the intake process, in order to increase the unit air charge, at the expense of work and power which must be delivered by the engine to the supercharger, in the system of the invention such pressure losses are reduced (not overcome) both during the exhaust and the intake processes, obtaining a reduction of the negative work of the pistons and increasing the unit air charge.

It is understood that the basic system of the invention can be incorporated to engines having any number of cylinders, any number of valves per cylinder and different arrangements.

DETAILED DESCRIPTION OF THE SYSTEM OF THE INVENTION

In the system of the invention all valves of the cylinder (both the intake and the exhaust valves of conventional engines) are driven simultaneously to accomplish the dual-duty, or dual-function, of exhausting combustion gases into passages external to the cylinder and then (in the next power cycle) admitting fresh air from the same passages into the cylinders. To said passages a continuous supply of air is forced to flow, by means of a fan (or a blower, or a compressor) driven by the engine, in order to sweep away combustion gases during the exhaust stroke and feed sufficient air during the intake stroke.

During the exhaust stroke the flow of air being supplied will be slowed down by the outcoming exhaust gases, while during the intake stroke the flow of air will be accelerated by the suction effect (or vacuum) produced by the piston moving away, while during the compression and power strokes the flow of air supplied will not be disturbed. Therefore, it may be estimated that the volume of air to be supplied per cycle will be approximately four times as much as the volume of air drawn by the pistons in order to obtain a suitable sweeping action of gases during the exhaust stroke and a sufficient supply of air during the intake stroke The optimum volume of air to be supplied depends on the particular characteristics of each engine and also on the shape and dimensions of the conduits. These may be found for each case in order to select the characteristics of the most suitable fan (or blower, or compressor).

The fan (or blower, or compressor) is driven by the engine, making use of a system of pulleys and belts, or gears, or chains and sprockets, or any other suitable system, so that the air supply is proportional to the speed of the engine and is therefore in accordance with the air demand of the engine at any speed.

The fuel injection is accomplished directly into the cylinder or into a precombustion chamber connected to the cylinder, or also outside the cylinder provided the air supply conduits are designed in such a way that the air drawn into the cylinder by the piston goes through the portion of the conduit where the fuel injector is located and the excess air supplied is diverted towards the exhaust manifold before it reaches the fuel injector, in such a way that no fuel is carried away and wasted by the air stream in the conduits external to the cylinder.

Figure 1A:
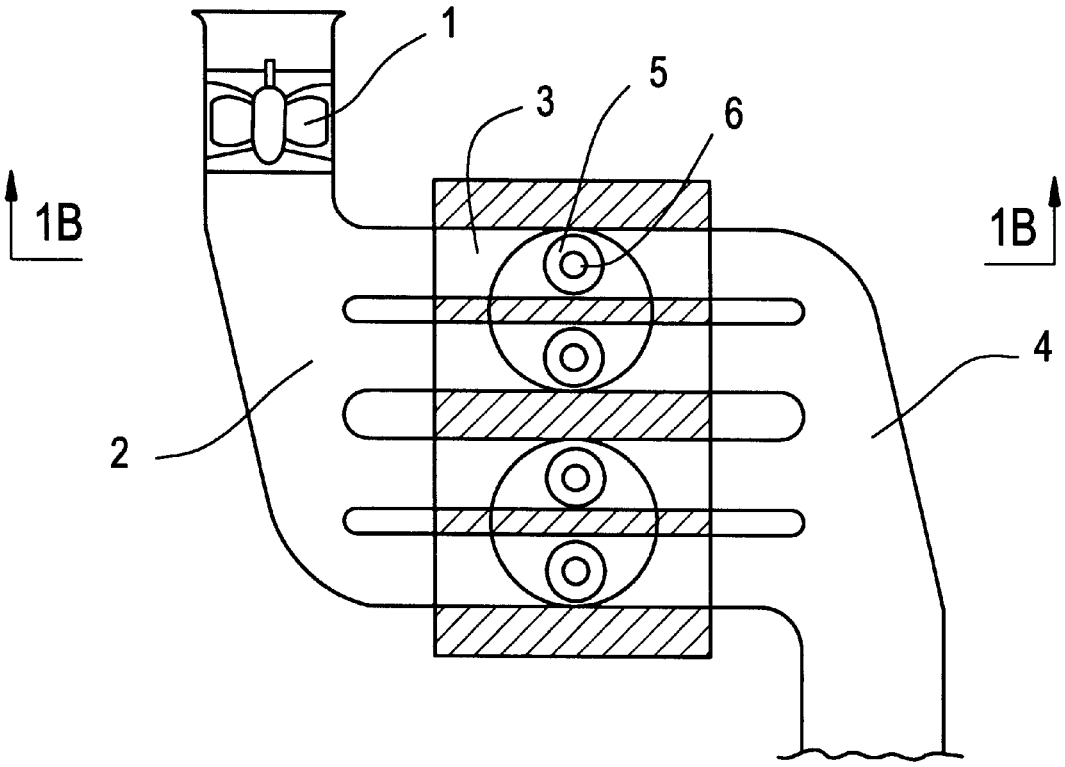
FIG. 1, enclosed, illustrates the basic system of the invention by means of a simplified schematic drawing, in plan view (B—B) and cross section (A—A), through the intake and exhaust manifolds and passages, of an in line two cylinder reciprocating piston engine, each cylinder being provided with two valves, and having the fuel injectors (not shown) located inside the cylinders.
Figure 1B:
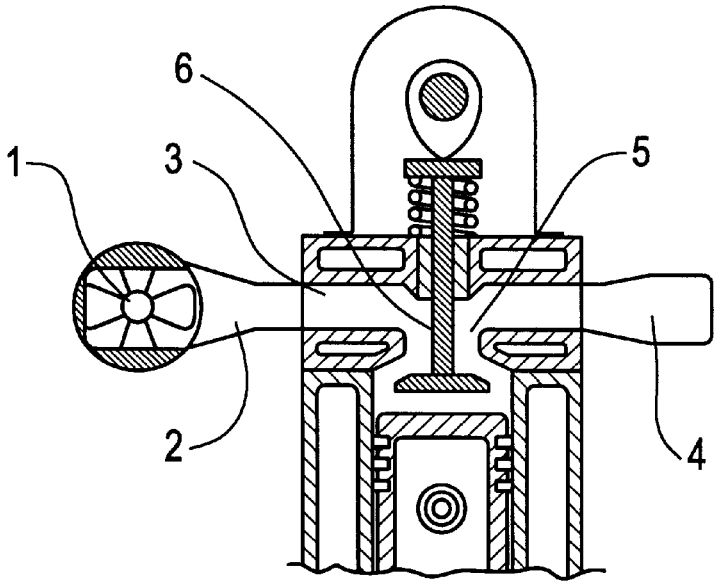
Figure 2:
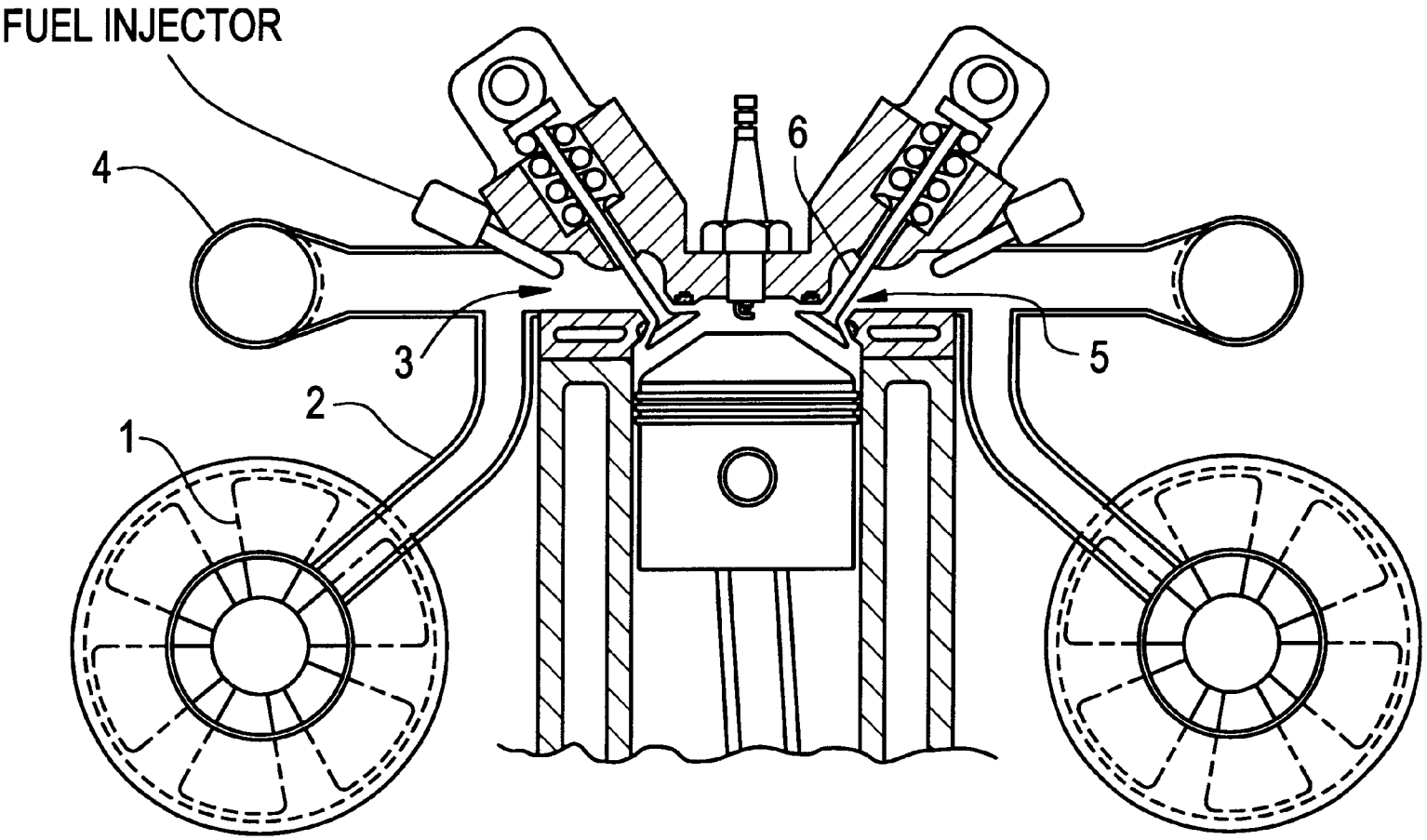
FIG. 2, enclosed, illustrates an alternative configuration of the basic system of the invention by means of a simplified schematic drawing, in cross section, through the intake and exhaust manifolds and passages, of an in line multi-cylinder reciprocating piston engine, each cylinder being provided with either two or four valves, and having the fuel Injectors located in the valve passages outside the cylinders.

Referring to FIG. 1 and/or FIG. 2, the system of the invention consists of the combination of the following elements and the dual function of the valves of the cylinders:

Air impeller (fan, or blower, or compressor) 1, driven by the engine, coupled to this intake manifold 2. Both the air impeller driving system and the fuel injectors and conventional.

Air passages 3, external to the cylinders, connected to the intake manifold and to the exhaust manifold 4. In these passages are located the ports 5 and the stems 6 of the poppet valves.

The valves of each cylinder are driven by means of a conventional system, such as a system of cams and springs as shown in the figure, except that it is designed to gradually open all valves of the cylinder from the beginning of the exhaust process until they reach full opening, to keep the valves at full opening for the remainder of the exhaust process and the first part of the intake process of the next cycle, and finally to gradually close the valves towards the end of the intake process.

What is claimed is:

1. Mechanical breathing system for a four-stroke, fuel injected internal combustion engine, provided with multiple-valves per cylinder, in which system each cylinder breathes through the opening of all of its valves, during both the exhaust process and the intake process, comprising:

at least one passage or conduit external to each engine cylinder, which provides a direct connection among an intake manifold, an exhaust manifold and valve ports of the respective cylinder, either through the engine head or outside the engine head;

an air impeller to produce a forced flow of air through the system, from the intake manifold to the exhaust manifold, in order to sweep away the combustion gases and feed fresh air to the cylinders, in such a way that each cylinder in turn, at the proper time in the operating cycle, discharges the combustion gases into the system through all its valves and immediately after takes fresh air from the same system through all its valves; and a valve driving system designed to open all the valves of each cylinder, during both the exhaust process and the intake process.

2. The mechanical breathing system for an internal combustion engine, according to claim 1, in which said air impeller is characterized by having either a fan, a blower, or a compressor, driven by the engine.

3. The mechanical breathing system for an internal combustion engine, according to claim 1, in which said air impeller is characterized by having either a fan, a blower, or a compressor, driven by an electric motor, or driven by a turbine which in turn is driven by the exhaust gases of the engine.

4. The mechanical breathing system for an internal combustion engine, according to claim 1, wherein said valve driving system is a mechanism of cams and springs wherein the profile of each cam is shaped so that during a part of its rotation, corresponding to a first part of the exhaust process from the respective cylinder, its radius of curvature increases gradually, in order to open all valves of the respective cylinder until they reach full opening; during another part of its rotations, corresponding to the remainder of that exhaust process and to a first part of the intake process of the next cycle, its radius of curvature is kept constant at maximum value to keep all valves of the respective cylinder at full opening; during another part of its rotation corresponding to the last part of the intake process, its radius of curvature decreases gradually to close all valves of that cylinder, and during the remainder of its rotation to complete one turn corresponding to the processes of compression and power, its radius of curvature is kept constant at minimum value to keep all valves of that cylinder closed.

5. The mechanical breathing system for an internal combustion engine, according to claim 1, wherein there is at least one intake manifold, and at least one exhaust manifold, there being direct connection among the intake manifold, the exhaust manifold and the valve ports of each cylinder either through the engine head or outside the engine head.

6. The mechanical breathing system for internal combustion engines according to claim 1 in which said external passages to the cylinders, or the branches of the intake manifold and/or the branches of the exhaust manifold, have non-return valves.

7. The mechanical breathing system for internal combustion engines according to claim 1 in which said external passages to the cylinders, or the branches of the intake manifold and/or the branches of the exhaust manifold, have rotating or the reciprocating valves.

8. A process for the breathing of internal combustion engines, operating in the four-stroke cycle and provided with fuel injectors and multiple-valves per cylinder, comprising passing exhaust combustion gas through all valves of the respective cylinder and admitting fresh air through all valves of the respective cylinder, said exhaust of gases and intake of flesh air is accomplished by passages external to the cylinder, having a forced flow of air which goes from the intake manifold to the exhaust manifold to sweep the gases and feed fresh air, in such a manner that each valve of the cylinder can accomplish the dual function of serving as both exhaust valve and intake valve.

* * * * *